US009955747B2

(12) United States Patent
Huebsch et al.

(10) Patent No.: US 9,955,747 B2
(45) Date of Patent: May 1, 2018

(54) DISSIPATIVE SYSTEM FOR SAFETY GARMENTS

(71) Applicant: E I DU PONT DE NEMOURS AND COMPANY, Wilmington, DE (US)

(72) Inventors: Eric Huebsch, Contern (LU); Muriel Samaniego, Oberkochen (DE)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 250 days.

(21) Appl. No.: 15/082,422

(22) Filed: Mar. 28, 2016

(65) Prior Publication Data

US 2016/0286893 A1 Oct. 6, 2016

Related U.S. Application Data

(60) Provisional application No. 62/142,080, filed on Apr. 2, 2015.

(51) Int. Cl.

| | |
|---|---|
| ***A43B 3/16*** | (2006.01) |
| ***A43B 7/36*** | (2006.01) |
| ***A43B 7/32*** | (2006.01) |
| ***H05F 3/02*** | (2006.01) |

(52) U.S. Cl.

CPC ..... *A43B 3/163* (2013.01); *A43B 7/32* (2013.01); *A43B 7/36* (2013.01); *H05F 3/02* (2013.01)

(58) Field of Classification Search

CPC .. A43B 3/163; A43B 7/32; A43B 7/34; A43B 7/36; H05F 3/02

See application file for complete search history.

(56) References Cited

U.S. PATENT DOCUMENTS

| | | | | |
|---|---|---|---|---|
| 2,958,012 A * | 10/1960 | Melman | ..... | A43B 3/163 252/511 |
| 3,081,519 A | 3/1963 | Blades et al. | | |
| 3,169,899 A | 2/1965 | Steuber | | |
| 3,227,784 A | 1/1966 | Blades et al. | | |
| 3,296,490 A * | 1/1967 | Price | ..... | A43B 3/163 36/1 |

(Continued)

FOREIGN PATENT DOCUMENTS

| | | | |
|---|---|---|---|
| WO | WO 2009091236 A1 * | 7/2009 | ..... A43B 3/163 |

*Primary Examiner* — Scott Bauer

(57) ABSTRACT

A system and overshoe for dissipating charge from a human body standing on a surface and wearing the system. The overshoe further contains a sole and an overshoe body that is attached to the edge of the sole such that the sole has an inner surface that faces the overshoe side and an outer surface that is exterior to the overshoe. A conductive strip is folded around at least a portion of the edge of the sole and bonded to the sole by a first adhesive such that at least a portion of the conductive strip is exposed to the inner surface of the sole. A tape covers the seam between the conductive strip and the sole on an exterior portion of the overshoe and that is adhesively bonded to the seam by a second adhesive such that at least a portion of the conductive strip is exposed to the surface that the human body is standing on.

The portion that is exposed to the surface that the human body is standing on is sufficient in area to yield a resistance of in the range of $>10^4$ to $<10^8$ Ohm when measured between the hands of the human body and the surface.

8 Claims, 4 Drawing Sheets

(56) References Cited

U.S. PATENT DOCUMENTS

| | | | | | |
|---|---|---|---|---|---|
| 3,308,562 | A | * | 3/1967 | Zimmon | A43B 3/163<br>12/142 R |
| 3,335,506 | A | * | 8/1967 | Pence | A43B 3/163<br>36/7.1 R |
| 3,359,658 | A | * | 12/1967 | Price | A43B 3/163<br>36/7.1 R |
| 3,381,173 | A | * | 4/1968 | De Woskin | A43B 3/163<br>36/1 |
| 3,564,335 | A | * | 2/1971 | Siegel | A43B 3/163<br>12/1 R |
| 3,684,922 | A | * | 8/1972 | Ericson | A43B 3/163<br>36/7.1 A |
| 3,800,446 | A | * | 4/1974 | Pass | A43B 3/106<br>36/7.1 R |
| 3,851,023 | A | | 11/1974 | Brethauer et al. | |
| 4,150,418 | A | * | 4/1979 | Berbeco | A43B 7/36<br>361/224 |

* cited by examiner

DISSIPATIVE SYSTEM FOR SAFETY GARMENTS

FIELD OF THE INVENTION

This invention relates generally to electrostatic protective devices, and in general to the protection of electrostatic sensitive equipment from static electricity built-up on clean room and other electrostatic protective garments.

BACKGROUND OF THE INVENTION

Protective apparel having high gas or liquid barrier and also having socks are not dissipative of electrical charges and may charge to a dangerous level. A means is therefore required to dissipate charges in an effective way without interfering with the integrity of the barrier.

With existing designs the charges are able to spread on one or both sides of the barrier substrate due to antistatic coating, but not from one side to the other through the substrate. Moreover, as charges are generated inside the garments due to movement they need to reach the ground on the outside the garment and so those charges have to be transferred through the substrate at some point. The present invention provides a system that protects a wearer of a protective suit from charge buildup and its consequences.

SUMMARY OF THE INVENTION

Figure 1:
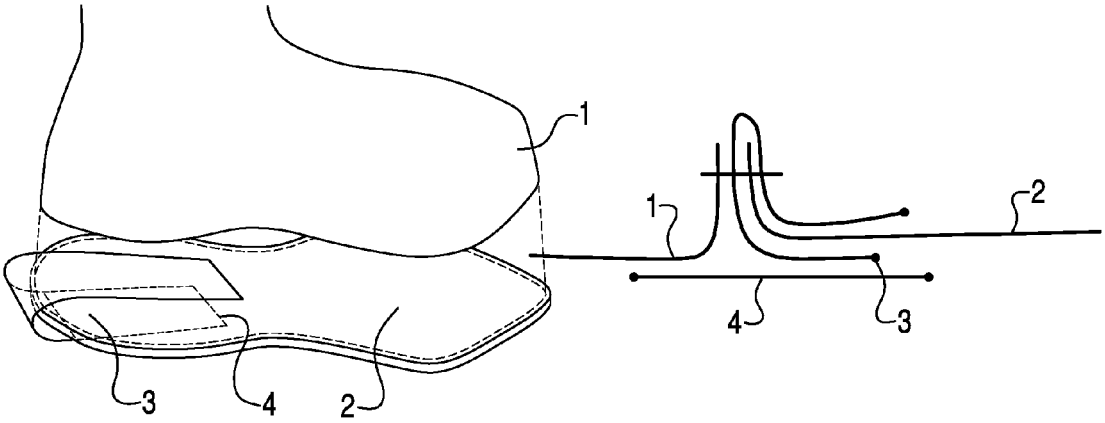
FIG. 1 shows a schematic diagram of the invention.

An object of this invention is to provide a device which prevents the accumulation of static electricity on the person or the electrostatic dissipating garment in an efficient manner with a minimum of interference to the person, and which includes provisions to minimize harm from accidental contact of the garment with high voltage sources.

All of the foregoing objects and others are achieved by a device for dissipating electrostatic electricity from a person wearing a static protective garment. The device comprises (a) a means for continuously conducting electricity between the garment and the person; and (b) a means for continuously conducting electricity from the garment or person to a ground.

The invention is also directed to a method of preventing electrostatic damage to a device which is sensitive to electrostatic potentials, said device being handled by a person wearing a static protective garment. The method comprises simultaneously and continuously grounding the person and the garment.

In a first embodiment the invention is directed to a system for dissipating charge from a human body standing on a surface and wearing the system, said system comprising a dissipative overshoe. The overshoe further comprises;

I. a sole,

II. an overshoe body that is attached to the edge of the sole such that the sole has an inner surface that faces the overshoe side and an outer surface that is exterior to the overshoe, III. a conductive strip folded around at least a portion of the edge of the sole and bonded to the sole by a first adhesive such that at least a portion of the conductive strip is exposed to the inner surface of the sole, IV. a tape that covers the seam between the conductive strip and the sole on an exterior portion of the overshoe and that is adhesively bonded to the seam by a second adhesive such that at least a portion of the conductive strip is exposed to the surface that the human body is standing on.

The portion that is exposed to the surface that the human body is standing on is sufficient in area to yield a resistance of in the range of $>10^4$ to $<10^8$ Ohm when measured between the hands of the human body and the surface.

In a further embodiment, the invention is directed to an overshoe comprising;

I. a sole,

II. an overshoe body that is attached to the edge of the sole such that the sole has an inner surface that faces the overshoe side and an outer surface that is exterior to the overshoe, III. a conductive strip folded around at least a portion of the edge of the sole and bonded to the sole by a first adhesive such that at least a portion of the conductive strip is exposed to the inner surface of the sole, IV. a tape that covers the seam between the conductive strip and the sole on an exterior portion of the overshoe and that is adhesively bonded to the seam by a second adhesive such that at least a portion of the conductive strip is exposed to the surface that the human body is standing on.

Also here the portion that is exposed to the surface that the human body is standing on is sufficient in area to yield a resistance of in the range of $>10^4$ to $<10^8$ Ohm when measured between the hands of the human body and the surface.

The overshoe body may be attached to the edge of the sole by stitching.

DETAILED DESCRIPTION OF THE INVENTION

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

By "consists essentially of" is meant that if Item A consists essentially of Item B, the further items may be added to item A that do not affect the operation of A.

The term "polymer" as used herein, generally includes but is not limited to, homopolymers, copolymers (such as for example, block, graft, random and alternating copolymers), terpolymers, etc., and blends and modifications thereof. Furthermore, unless otherwise specifically limited, the term "polymer" shall include all possible geometrical configurations of the material. These configurations include, but are not limited to isotactic, syndiotactic, and random symmetries.

The term "polyolefin" as used herein, is intended to mean any of a series of largely saturated polymeric hydrocarbons composed only of carbon and hydrogen. Typical polyolefins include, but are not limited to, polyethylene, polypropylene, polymethylpentene, and various combinations of the monomers ethylene, propylene, and methylpentene.

The term "polyethylene" as used herein is intended to encompass not only homopolymers of ethylene, but also copolymers wherein at least 85% of the recurring units are ethylene units such as copolymers of ethylene and alpha-olefins. Preferred polyethylenes include low-density polyethylene, linear low-density polyethylene, and high-density polyethylene. A preferred high-density polyethylene has an upper limit melting range of about 130° C. to 140° C., a density in the range of about 0.941 to 0.980 gram per cubic centimeter, and a melt index (as defined by ASTM D-1238-57T Condition E) of between 0.1 and 100, and preferably less than 4.

The term "polypropylene" as used herein is intended to embrace not only homopolymers of propylene but also copolymers where at least 85% of the recurring units are propylene units. Preferred polypropylene polymers include isotactic polypropylene and syndiotactic polypropylene.

The term "plexifilament" as used herein means a three-dimensional integral network or web of a multitude of thin, ribbon-like, film-fibril elements of random length. Typically, these have a mean film thickness of less than about 4 micrometers and a median fibril width of less than about 25 micrometers. The average film-fibril cross sectional area if mathematically converted to a circular area would yield an effective diameter between about 1 micrometer and 25 micrometers. In plexifilamentary structures, the film-fibril elements intermittently unite and separate at irregular intervals in various places throughout the length, width and thickness of the structure to form a continuous three-dimensional network. Examples of plexifilamentary webs are those produced by the processes described in U.S. Pat. No. 3,081,519 (Blades et al.), U.S. Pat. No. 3,169,899 (Steuber), U.S. Pat. No. 3,227,784 (Blades et al.), U.S. Pat. No. 3,851,023 (Brethauer et al.), the contents of which are hereby incorporated by reference in their entirety. Examples of commercially available plexifilamentary webs are the sheets suppled by the DuPont company of Wilmington, Del. under the name Tyvek®.

The term "nonwoven" means a web including a multitude of randomly distributed fibers. The fibers generally can be bonded to each other or can be unbonded. The fibers can be staple fibers or continuous fibers. The fibers can comprise a single material or a multitude of materials, either as a combination of different fibers or as a combination of similar fibers each comprised of different materials.

By "exposed region" is meant a region that is exposed to and capable of being in electrical contact with a surface that a person wearing the overshoe of the invention is standing on.

The words "dissipative" and "conductive" are synonymous herein.

The present invention is directed to a system for dissipating charge from a human body that is standing on a surface and wearing the system, said system comprising a dissipative overshoe. The overshoe further comprises;

I. a sole,

II. an overshoe body that is attached to the edge of the sole such that the sole has an inner surface that faces the overshoe side and an outer surface that is exterior to the overshoe, III. a conductive strip folded around at least a portion of the edge of the sole and bonded to the sole by a first adhesive such that at least a portion of the conductive strip is exposed to the inner surface of the sole, IV. a tape that covers the seam between the conductive strip and the sole on an exterior portion of the overshoe and that is adhesively bonded to the seam by a second adhesive such that at least a portion of the conductive strip is exposed to the surface that the human body is standing on.

The portion that is exposed to the surface that the human body is standing on is sufficient in area to yield a resistance of in the range of $>10^4$ to $<10^8$ Ohm when measured between the hands of the human body and the surface.

In a further embodiment, the invention is directed to an overshoe comprising;

I. a sole,

II. an overshoe body that is attached to the edge of the sole such that the sole has an inner surface that faces the overshoe side and an outer surface that is exterior to the overshoe, III. a conductive strip folded around at least a portion of the edge of the sole and bonded to the sole by a first adhesive such that at least a portion of the conductive strip is exposed to the inner surface of the sole, IV. a tape that covers the seam between the conductive strip and the sole on an exterior portion of the overshoe and that is adhesively bonded to the seam by a second adhesive such that at least a portion of the conductive strip is exposed to the surface that the human body is standing on.

FIG. 1 shows an schematic example of the invention in which a dissipative (conductive) stripe (3) is folded around an outside edge of a Tychem® (Dupont, Wilmington, Del.) sole (2). The stripe is taped (4) in place on the exterior surface of the sole, and also has a portion residing on the interior surface of the sole.

Figure 2:
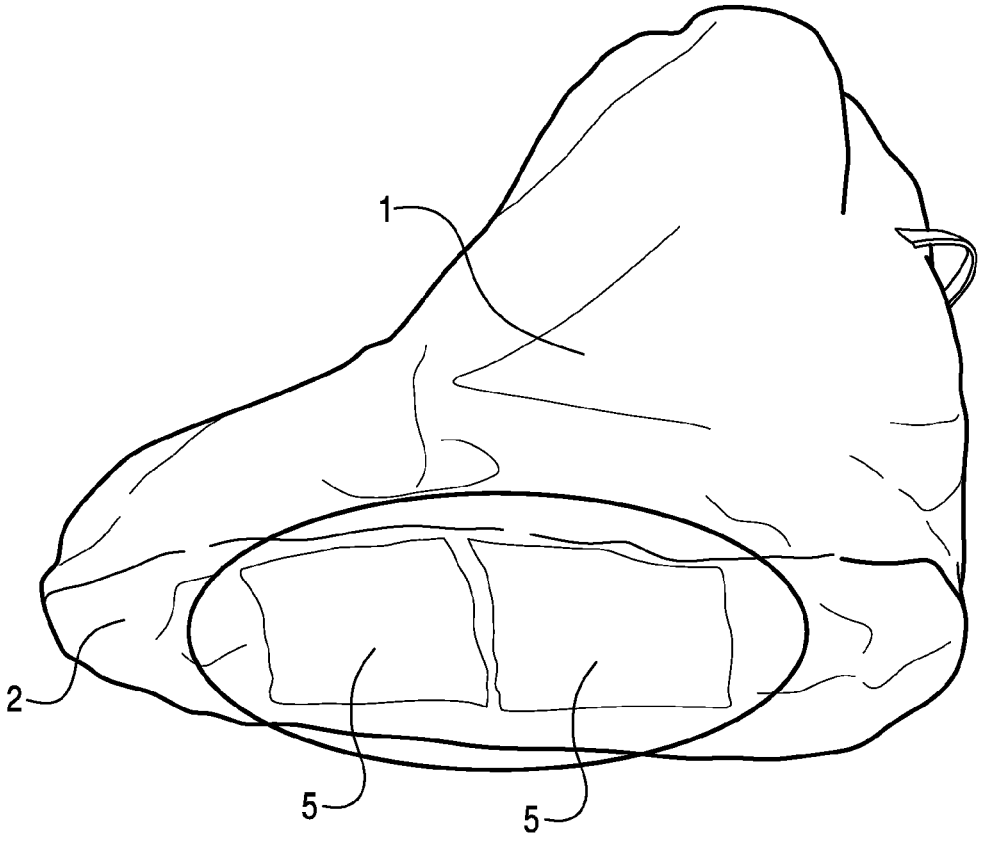
FIG. 2 shows an example of an overshoe and sole with two large conductive stripes
Figure 3:
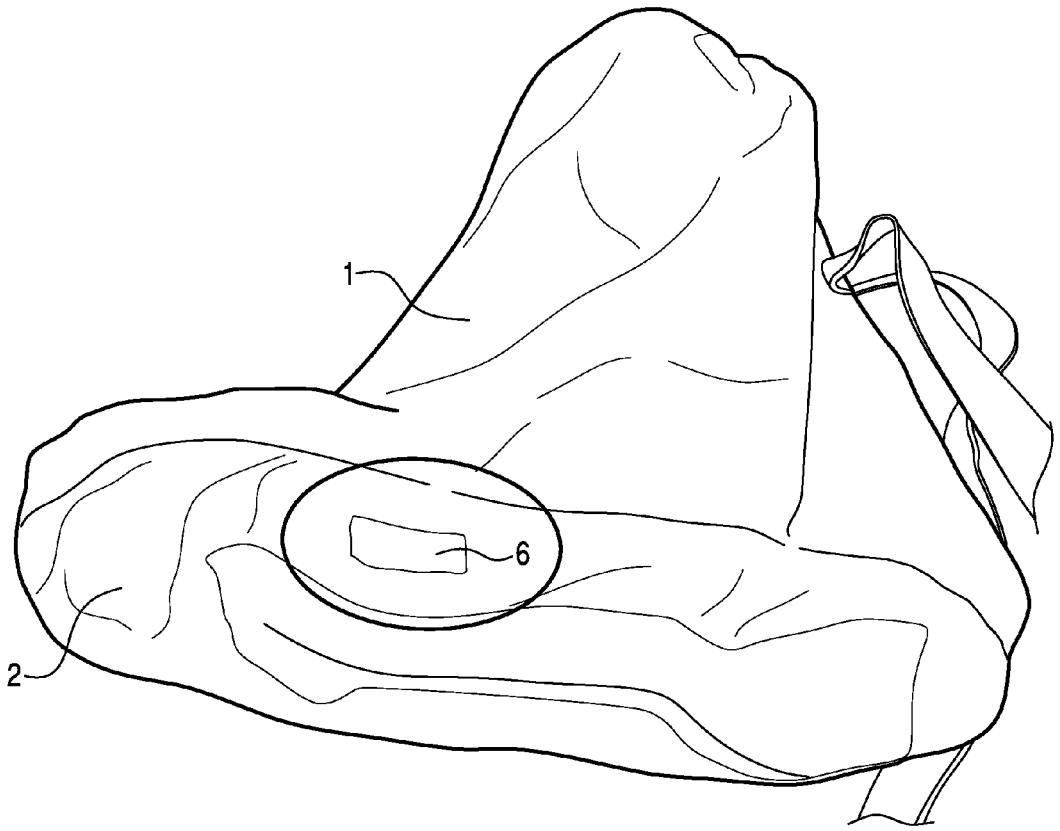
FIG. 3 shows an example of an overshoe and sole with one small conductive stripe.
Figure 4:
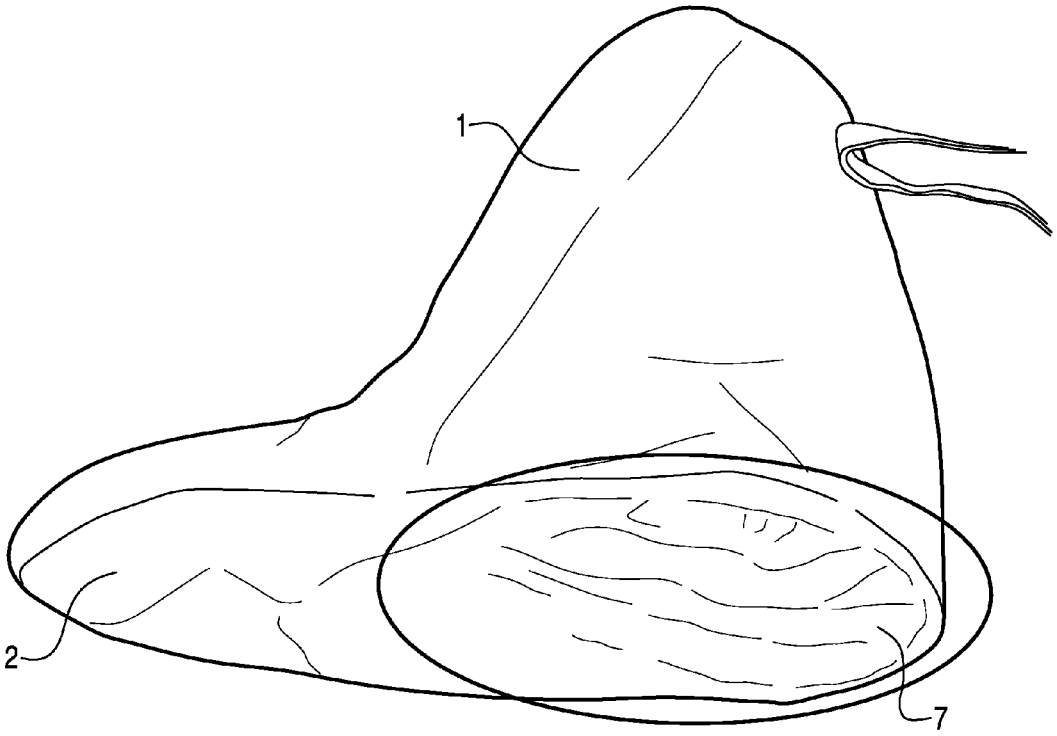
FIG. 4 shows an example of an overshoe and sole with one heel conductive stripes

FIGS. 2-4 show photographs of the constructions used in the examples.

FIG. 2 shows an example of an overshoe (1) and sole (2) with two large conductive stripes (5). FIG. 3 shows an example of an overshoe (1) and sole (2) with one small conductive stripe (6). FIG. 4 shows an example of an overshoe (1) and sole (2) with one heel conductive stripe (7).

In one embodiment a portion of the overshoe comprises a nonwoven web. The nonwoven web may also be a plexifilamentary web.

In a further embodiment the conductive strip comprises a contiguous layer of metalized plexifilamentary web.

An as-spun nonwoven used in the present invention can be consolidated by processes known in the art (e.g. calendering) in order to impart the desired improvements in physical properties required in any embodiment of the embodiment. The term "consolidated" generally means that the nonwoven has been through a process in which it is compressed and its overall porosity has been reduced. In one embodiment of the invention the as-spun nonwoven is fed into the nip between two unpatterned rolls in which one roll is an unpatterned soft roll and one roll is an unpatterned hard roll. The temperature of one or both rolls, the composition and hardness of the rolls, and the pressure applied to the nonwoven can be varied to yield the desire end use properties. In one embodiment of the invention, one roll is a hard metal, such as stainless steel, and the other a soft-metal or polymer-coated roll or a composite roll having a hardness less than Rockwell B 70. The residence time of the web in the nip between the two rolls is controlled by the line speed of the web, preferably between about 1 m/min and about 50 m/m in, and the footprint between the two rolls is the machine direction (MD) distance that the web travels in contact with both rolls simultaneously. The footprint is controlled by the pressure exerted at the nip between the two rolls and is measured generally in force per linear cross-direction (CD) dimension of roll, and is preferably between about 1 mm and about 30 mm.

Further, the nonwoven web can be stretched, optionally while being heated to a temperature that is between the glass-transition temperature ($T_g$) and the lowest onset-of-melting temperature ($T_{om}$) of the fiber polymer. The stretching can take place either before and/or after the web passes through the calender roll nip, and in either or both of the MD or CD.

EXAMPLES

Testing

The effectiveness of various constructions of overshoe was test with an apparatus for testing the whole body resistance of a human subject. (Item EMW 13, Eltha, Regensburg, Germany.)

The entire clothing system of employees entering into hazardous zones is analyzed with this instrument in order to verify whether the conductivity between hands and shoe sole is in the safe range of $>10^4$ to $<10^8$ Ohm.

The test person has walks onto a metal plate with both safety shoes and grabs two handles with both hands. Only if the measurement results stated the conductivity being between the range of $>10^4$ to $<10^8$ Ohm then LED's on the instrument show green and it is safe to enter the hazardous zone with the selected garment combination. The instrument measures electrical resistance between the surface of the hands and the shoes, and if resistance $<10^8\Omega$ then the person plus clothing passes the test.

Results

In all examples below Tyvek and Tychem branded products came from E.I. DuPont de Nemours, DE, USA or affiliates.

As shown on the table below, only products, regardless whether used as socks in dissipative shoes or as overshoes over dissipative shoes, are considered to be performing according to the invention if the resistance is above $10^8$ ohm and not below $10^4$ ohm.

Tychem® F; Tychem® SL and Tychem® C alone are typically insulated laminated material, coated with antistatic formulations of the art, which prevent dissipation hence a resistance higher than $10^8$ ohm and therefore do not meet the invention embodiments.

In the table below the use of stripes, with for example Tychem® F, which are undersized, meaning too small, does not insure proper dissipation, hence a resistance above $10^8$ ohm (see 1 heel stripe and 1 small stripe cases in the table).

Only properly sized stripes (for example associated with Tychem® F—with 2× large stripe) or the use of Tyvek® Labo with a known in the art antistatic treatment on both faces, do meet the dissipation requirements of the invention, i.e. a resistance above $10^8$ ohm and not below $10^4$ ohm.

| Substrate | design | resistance (Ω) |
|---|---|---|
| Tychem ® F with small stripe, see FIG. 3.) | over shoe | $>10^8$ |
| | socks | $>10^8$ |
| Tychem ® SL | over shoe | $>10^8$ |
| | socks | $>10^8$ |
| Tychem ® C | over shoe | $>10^8$ |
| | socks | $>10^8$ |
| Tyvek ® Labo | over shoe | $\leq 10^8$; $>10^4$ |
| | socks | $\leq 10^8$; $>10^4$ |
| Tychem ® F with 2x large stripes (see FIG. 2.) | over shoe | $\leq 10^8$; $>10^4$ |
| | socks | $\leq 10^8$; $>10^4$ |
| Tychem ® F with 1 heel stripe (see FIG. 4.) | over shoe | $>10^8$ |
| | socks | $>10^8$ |
| Tychem ® F with 1 small stripe | over shoe | $>10^8$ |
| | socks | $>10^8$ |

We claim:

1. A system for dissipating charge from a human body standing on a surface and wearing the system, said system comprising a dissipative overshoe, said overshoe further comprising;

I. a sole,

II. an overshoe body that is attached to the edge of the sole such that the sole has an inner surface that faces the overshoe side and an outer surface that is exterior to the overshoe, III. a conductive strip folded around at least a portion of the edge of the sole and bonded to the sole by a first adhesive such that at least a portion of the conductive strip is exposed to the inner surface of the sole, IV. a tape that covers the seam between the conductive strip and the sole on an exterior portion of the overshoe and that is adhesively bonded to the seam by a second adhesive such that at least a portion of the conductive strip is exposed to the surface that the human body is standing on;

wherein the portion that is exposed to the surface that the human body is standing on is sufficient in area to yield a resistance of in the range of $>10^4$ to $<10^8$ Ohm when measured between the hands of the human body and the surface.

2. The system of claim 1 in which the human body has a conductivity of between $10^6$ and $10^8$ (units).

3. The system of claim 1 in which at least a portion of the overshoe comprises a nonwoven web.

4. The system of claim 3 in which the nonwoven web is a plexifilamentary web.

5. The system of claim 1 in which the conductive strip comprises a contiguous layer of metalized plexifilamentary web.

6. The system of claim 1 in which the second adhesive is a hot melt adhesive.

7. The system of claim 1 in which the conductive strip comprises carbon particles.

8. An overshoe comprising;

I. a sole,

II. an overshoe body that is attached to the edge of the sole such that the sole has an inner surface that faces the overshoe side and an outer surface that is exterior to the overshoe, III. a conductive strip folded around at least a portion of the edge of the sole and bonded to the sole by a first adhesive such that at least a portion of the conductive strip is exposed to the inner surface of the sole, IV. a tape that covers the seam between the conductive strip and the sole on an exterior portion of the overshoe and that is adhesively bonded to the seam by a second adhesive such that at least a portion of the conductive strip is exposed to the surface that the human body is standing on.

* * * * *